US008342945B2

(12) United States Patent
Gomez

(10) Patent No.: US 8,342,945 B2
(45) Date of Patent: Jan. 1, 2013

(54) WAGERING GAME WITH COLLECTION FEATURE FOR TRIGGERING SPECIAL EVENT

(75) Inventor: Benjamin T. Gomez, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 945 days.

(21) Appl. No.: 12/305,561

(22) PCT Filed: Jun. 8, 2007

(86) PCT No.: PCT/US2007/013570

§ 371 (c)(1),
(2), (4) Date: Dec. 18, 2008

(87) PCT Pub. No.: WO2007/149238

PCT Pub. Date: Dec. 27, 2007

(65) Prior Publication Data

US 2009/0209317 A1 Aug. 20, 2009

Related U.S. Application Data

(60) Provisional application No. 60/815,044, filed on Jun. 20, 2006.

(51) Int. Cl.
*A63F 9/24* (2006.01)

(52) U.S. Cl. ..... 463/25; 463/16; 463/17; 463/18; 463/19; 463/20; 463/29; 463/30

(58) Field of Classification Search ..... 463/16–22, 463/25, 29, 30; 273/138, 139, 143
See application file for complete search history.

(56) References Cited

U.S. PATENT DOCUMENTS

| | | | | |
|---|---|---|---|---|
| 6,270,411 | B1 | 8/2001 | Gura et al. | |
| 6,270,412 | B1 * | 8/2001 | Crawford et al. | 463/20 |
| 7,862,420 | B2 * | 1/2011 | Peterson et al. | 463/20 |
| 2005/0164774 | A1 * | 7/2005 | Gauselmann | 463/20 |
| 2006/0068893 | A1 * | 3/2006 | Jaffe et al. | 463/20 |

OTHER PUBLICATIONS

Written Opinion corresponding to co-pending International Patent Application Serial No. PCT/US2007/013570, United States Patent Office, dated Sep. 16, 2008.

International Search Report corresponding to co-pending International Patent Application Serial No. PCT/US2007/013570, United States Patent Office, dated Sep. 16, 2008.

* cited by examiner

*Primary Examiner* — Sunit Pandya
(74) *Attorney, Agent, or Firm* — Nixon Peabody LLP

(57) ABSTRACT

A gaming machine for conduction a wagering game is disclosed according to one embodiment. The gaming machine comprises a wager input device for receiving a primary wager to play the wagering game. The wagering game further includes at least one display for displaying a randomly selected outcome of a basic game of the wagering game. The randomly selected outcome is indicated by a plurality of symbols. At least one of the symbols is a bonus symbol that triggers a bonus game in response to a certain condition being met. In response to the randomly selected outcome including at least one bonus symbol without the certain condition being met, the at least one bonus symbol may be utilized in a subsequent basic game to trigger a bonus game in the subsequent basic game if the certain condition is met.

11 Claims, 7 Drawing Sheets

WAGERING GAME WITH COLLECTION FEATURE FOR TRIGGERING SPECIAL EVENT

CROSS REFERENCE TO RELATED APPLICATIONS

This application is a U.S. national phase of International Application No. PCT/US2007/013570 filed Jun. 8, 2007, and claims the benefit of priority of U.S. Provisional Application Ser. No. 60/815,044, filed Jun. 20, 2006, which is incorporated by reference in its entirety herein.

FIELD OF THE INVENTION

The present invention relates generally to gaming machines, and methods for playing wagering games, and more particularly, to a gaming machine including new ways of achieving a bonus game.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Because the bonus game concept offers tremendous advantages in player appeal and excitement relative to other known games, and because such games are attractive to both players and operators, there is a continuing need to develop gaming machines with new types of bonus games and new ways to achieve such bonus games to satisfy the demands of players and operators.

SUMMARY OF THE INVENTION

A gaming machine for conduction a wagering game is disclosed according to one embodiment. The gaming machine comprises a wager input device for receiving a primary wager to play the wagering game. The wagering game further includes at least one display for displaying a randomly selected outcome of a basic game of the wagering game. The randomly selected outcome is indicated by a plurality of symbols. At least one of the symbols is a bonus symbol that triggers a bonus game in response to a certain condition being met. In response to the randomly selected outcome including at least one bonus symbol without the certain condition being met, the at least one bonus symbol may be utilized in a subsequent basic game to trigger a bonus game in the subsequent basic game if the certain condition is met.

A method of conducting a wagering game on a gaming machine is disclosed according to one embodiment. The method comprises the act of receiving a primary wager. The method further comprises the act of initiating a basic game of the wagering game. The method further comprises the act of displaying a randomly selected outcome of the basic game via a plurality of symbols selected from a set of symbols including at least one bonus symbol. In response to the outcome of the basic game including at least one, but less than a predetermined quantity of the bonus symbols necessary to trigger the bonus game, the method further comprises the act of storing the at least one bonus symbol for use with a bonus symbol achieved in a subsequent basic game to trigger a bonus game in the subsequent basic game.

A method of conducting a wagering game having a basic game and a bonus game is also disclosed. The method includes the act of initiating the basic game having a plurality of symbols, at least one of the symbols is a bonus symbol. The method further includes the act of displaying the outcome of a plurality of plays of the basic game with the plurality of symbols. The method still further includes the act of collecting the bonus symbols that are achieved in the plurality of plays of the basic game. The method also includes the act of triggering the bonus game in a subsequent play of the basic game that includes at least one additional bonus symbol. The collected bonus symbols and the at least one additional bonus symbol is greater than a predetermined number of bonus symbols necessary for triggering the bonus game.

A gaming machine for conducting a wagering game according to another embodiment is disclosed. The gaming machines includes a wager input device. The gaming machine further includes at least one display for displaying a randomly selected outcome of a basic game. The randomly selected outcome is indicated by a plurality of symbols arranged in an array. The plurality of symbols is selected from a set of symbols and at least one of the symbols in the set is a bonus symbol. The display displays a bonus game in response to a certain number of bonus symbols being collected during multiple plays of the bonus game.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
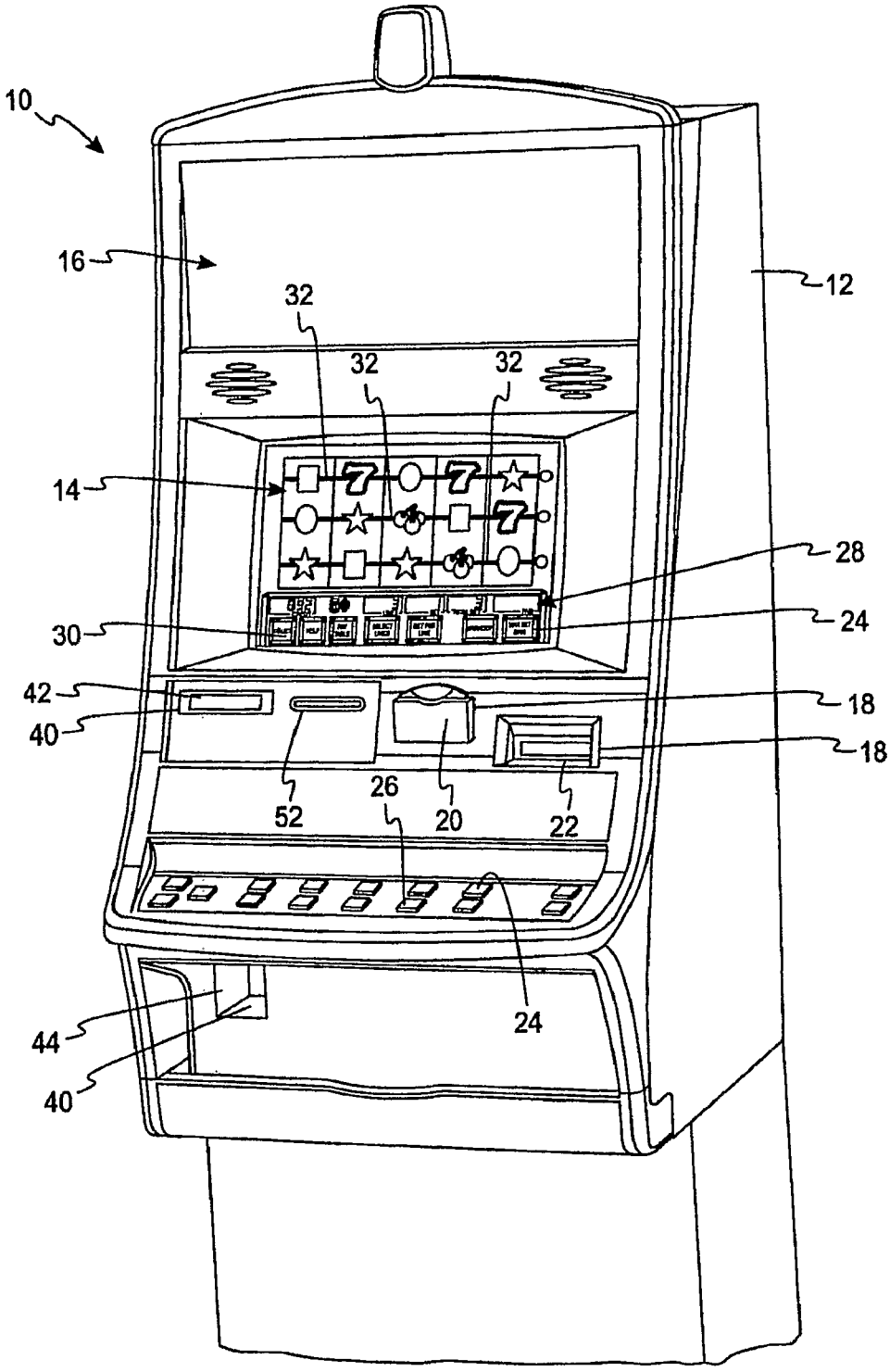
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
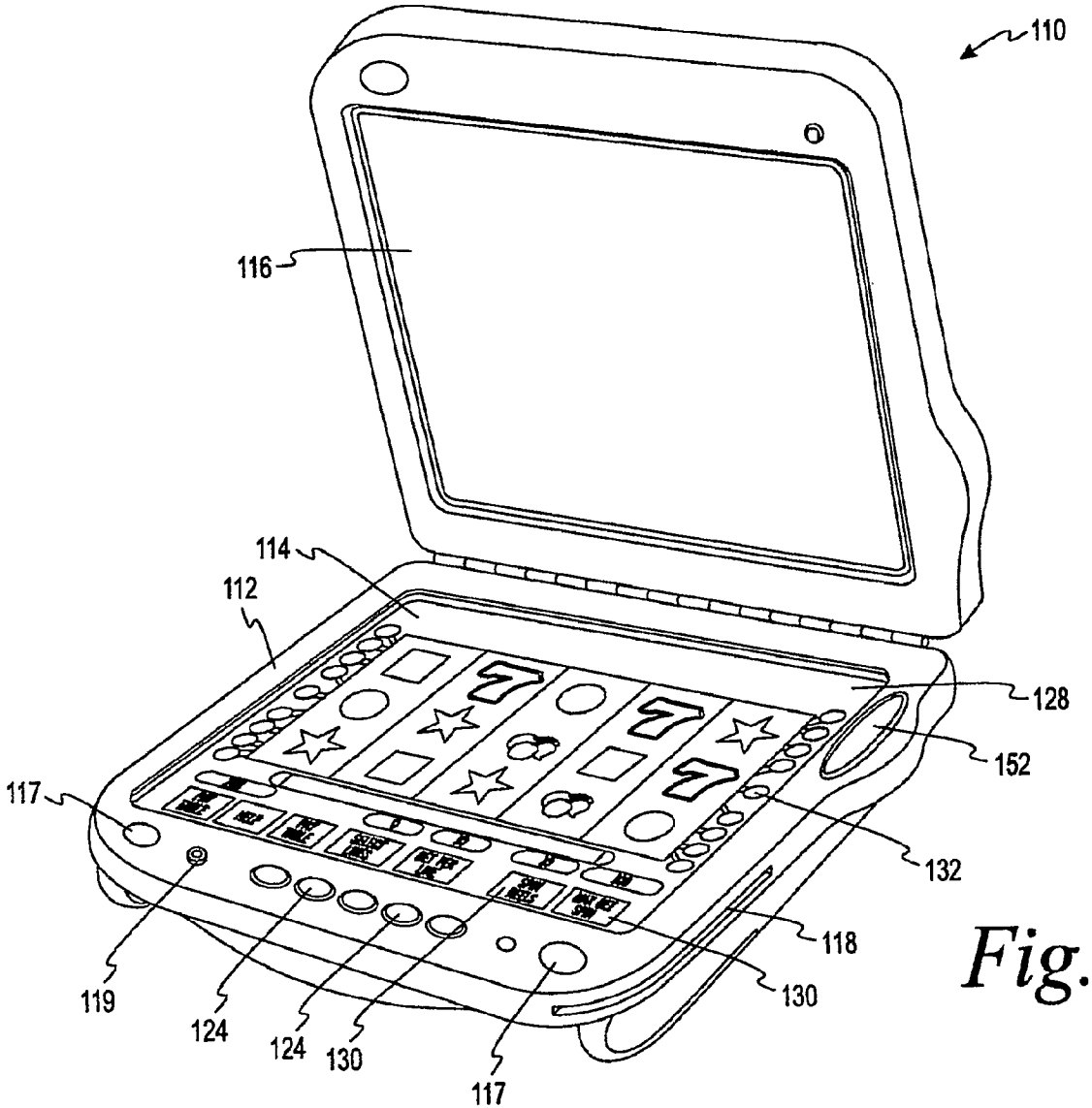
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons 126 on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
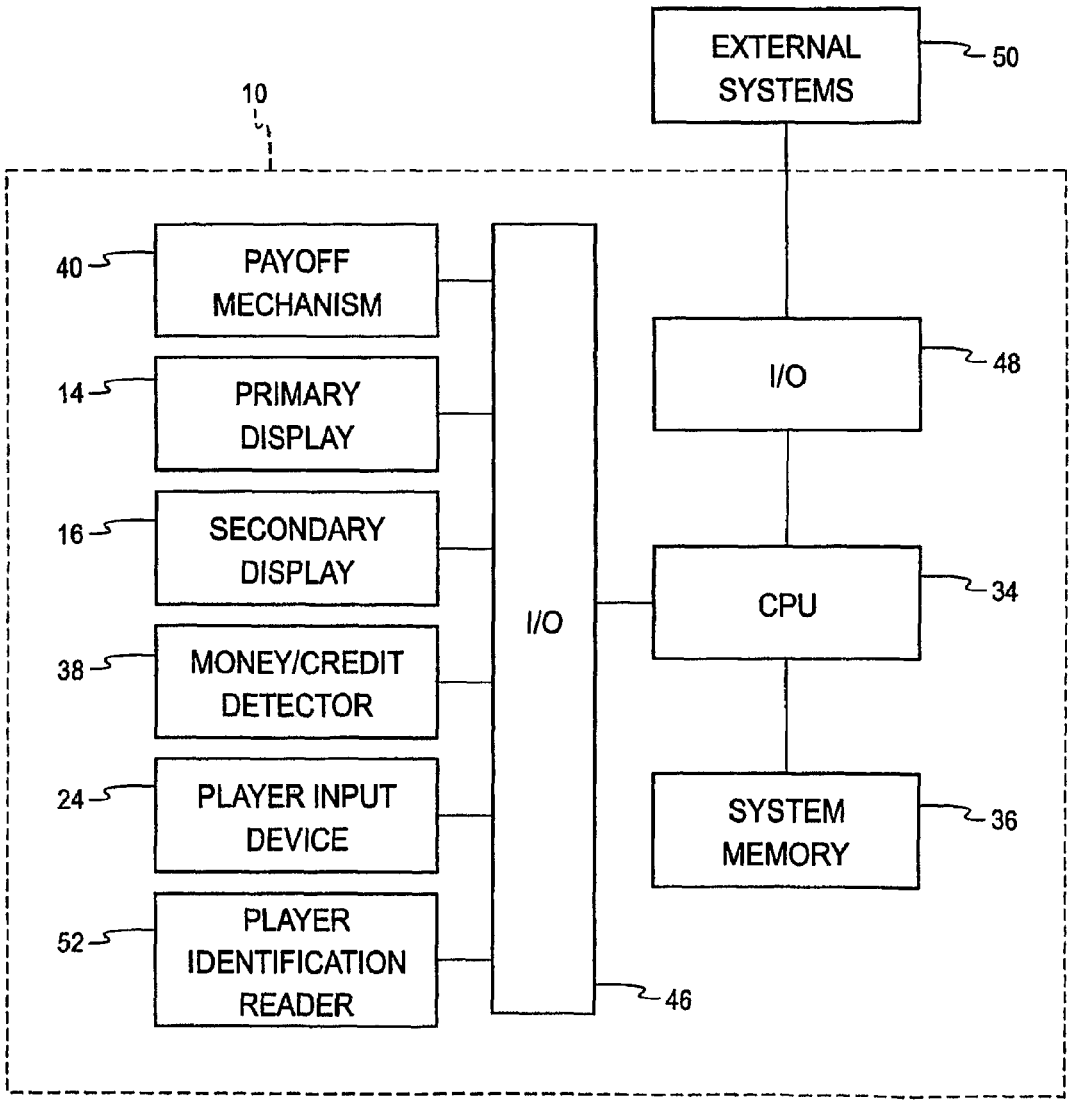
FIG. 2 is a block diagram of a control system suitable for operating the gaming machines of FIGS. 1*a* and 1*b*.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

The gaming machines 10, 110 may communicate with external systems 50 (in a wired or wireless manner) such that each machine operates as a "thin client," having relatively less functionality, a "thick client," having relatively more functionality, or through any range of functionality therebetween. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
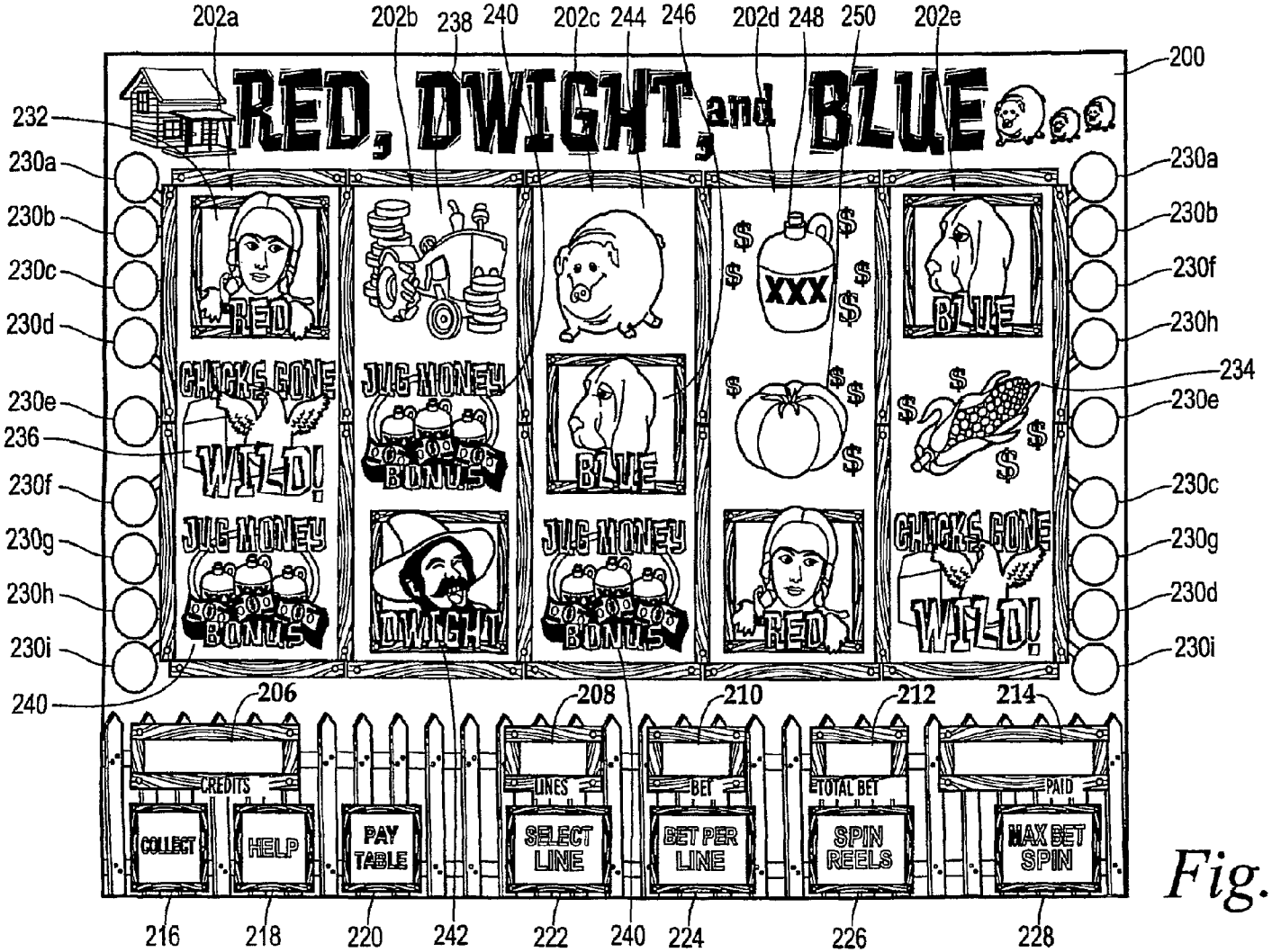
FIG. 3 is an illustration of a basic game incorporating the present invention.

Turning now to FIG. 3, an image of a main game screen 200 is illustrated, according to one embodiment of the present invention. A player begins play of a basic wagering game by inserting a wager into the value input device 18 of the gaming machine 10. A player can select play by using the player input device 24, via the buttons 26 or the touch screen keys 30. The CPU 34 (or a wagering game control network in alternative embodiments) operates to execute a wagering game program causing the primary display 14 to display the wagering game that includes a plurality of visual elements.

The basic game screen 200 may be displayed on the primary display 14 or on a portion thereof. In the illustrated embodiment, the basic game screen 200 is used to display a plurality of simulated, movable reels 202*a-e* with symbols displayed thereon. The reels 202*a-e* are positioned such that the symbols are displayed relative to at least one payline, indicating a plurality of outcomes for the basic game. The basic game screen 200 may also display a plurality of game session meters and various buttons selectable by a player. The game session meters include a "credit" meter 206 for displaying a number of credits available for play on the machine; a "lines" meter 208 for displaying a number of paylines to be played by a player on the machine; a "bet" meter 210 for displaying a number of credits wagered (e.g., from 1 to 5 credits) for each of the number of paylines played; a "total bet" meter 212 for displaying a total number of credits wagered for the particular round of wagering; and a "paid" meter 214 for displaying an amount to be awarded based on the results of the particular rounds wager. The user-selectable buttons include a "collect" button 216 to collect the credits remaining in the credits meter 206; a "help" button 218 for viewing instructions on how to play the wagering game; a "pay table" button 220 for viewing a pay table associated with the basic wagering game; a "select lines" button 222 for changing the number of paylines (displayed in the lines meter 208) a player wishes to play; a "bet per line" button 224 for changing the amount of the wager which is displayed in the bet meter 210; a "spin reels" button 226 for moving the reels 202*a-e*; and a "max bet spin" button 228 for wagering a maximum number of credits and moving the reels 202*a-e* of the basic wagering game. While the gaming machine 10 allows for these types of player inputs, the present invention does not require them and can be used on gaming terminals having more, less, or different player inputs.

In FIG. 3, the five depicted reels 202*a-e* have a plurality of symbols displayed thereon and at least one activated payline extending from one of the payline indicators 230*a-i* on the left side of the screen 200 to the corresponding payline indicators 230*a-i* on the right side of the screen 200. The plurality of symbols displayed on the reels 202*a-e* are used to indicate a plurality of possible outcomes along each of the activated paylines. The depicted symbols all correspond to a "COUNTRY" theme and include: "RED" symbols 232; "CORN" symbols 234; "CHICKS GONE WILD" symbols 236; "TRACTOR" symbols 238; "JUG MONEY BONUS" symbols 240; "DWIGHT" symbols 242; "PRIZE PIG" symbols 244; "BLUE" symbols 246; "MOONSHINE JUG" symbols 248; and "TOMATO" symbols 250. Other COUNTRY-themed symbols may also be depicted. In other embodiments of the present invention, the gaming machine 10 may portray other themes with corresponding like-themed symbols. Further, standard gaming symbols such as "1-BAR" symbols, "2-BAR" symbols, "3-BAR" symbols, "CHERRY" symbols, "SEVEN" symbols, and "BELL" symbols may be depicted on the reels 202*a-e* in other embodiments. The reels 202*a-e* displaying these symbols may be either traditional mechanical reels or they may be computer-generated images of reels.

A winning combination occurs when the symbols appearing on the reels 202*a-e* along an active payline correspond to one of the winning symbol combinations listed in a pay table stored in the system memory 36 of the gaming machine 10, 110. The pay table may also be displayed on the secondary display 16, the primary display 14, or both and be either displayed constantly, intermittently, or upon request by a player (e.g., by selecting the pay-table button 80).

A player may play multiple paylines by selecting the select-lines button 222 until the desired number of paylines (up to nine in the illustrated embodiment) are displayed. While an embodiment with nine paylines is shown, a gaming machine 10 with a single payline, or multiple paylines will also work with the present invention. Additionally, although an embodiment with five reels is shown, a gaming machine 10 with any plurality of reels may also be used in accordance with the present invention.

During basic game play, a bonus game may be triggered in a number of ways. According to one embodiment, a bonus game is triggered when three JUG MONEY BONUS symbols 240 appear anywhere on the first three reels (202*a*-202*c*), as illustrated in FIG. 3 (i.e., achieved in a "scatter" format). In some embodiments, a bonus game is triggered when at least two bonus symbols are displayed anywhere on the reels 202*a-e*. In other embodiments, a bonus game is triggered when at least two bonus symbols are aligned along an active payline 32. Other methods of achieving a bonus game are also contemplated and the methods disclosed above are provided by way of example and should not limit the scope of the present invention.

Various types of bonus games may be triggered from the basic game. One non-limiting example of a bonus game is a Jug Money Bonus game, illustrated in FIG. 4. In this type of game, the player selects moonshine jugs 260 for credit awards 262 until a "Sheriff Revenuer" symbol 264 is revealed, which ends the bonus game. If a "Red" symbol 265 is revealed before the "Sheriff Revenuer" symbol 264, then all the following moonshine jug 260 picks will be awarded at twice their value. If a "Dwight" symbol 266 is revealed before the "Sheriff Revenuer" symbol 264, then all of the following moonshine jug 260 picks will be awarded at five times their credit value. If a "Blue" symbol 268 is revealed, any subsequently revealed "Sheriff Revenuer" symbols 264 will be nullified and the bonus game will continue.

Figure 4:
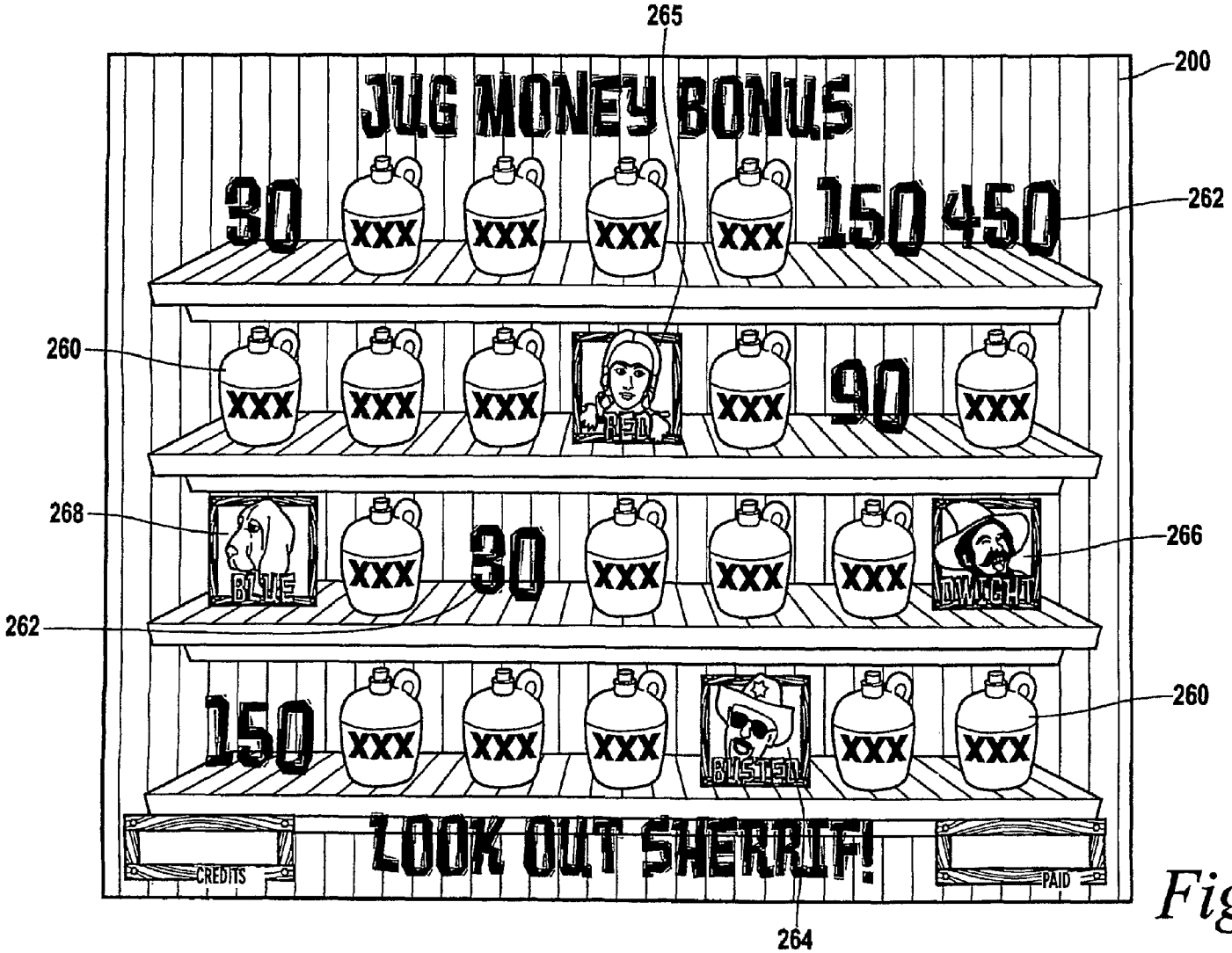
FIG. 4 is an illustration of a bonus game achievable from the basic game of FIG. 3.

The Jug Money Bonus game illustrated in FIG. 4 is one specific example of a variety of types of bonus games that may be played in accordance with the present invention. Any bonus game may be utilized and the type of bonus game should not limit the scope of the present invention.

The basic game (of FIG. 3) includes a collect-a-bonus feature to assist the triggering of a bonus game (e.g., Jug Money Bonus game of FIG. 4). The collect-a-bonus feature generally allows a player to collect a bonus-triggering symbol (e.g., the JUG MONEY BONUS symbols 240) over multiple spins. The collect-a-bonus feature may be always present in the basic game or only activated under certain conditions, such as the placement of a side-bet. In some embodiments, the game screen 200 of the basic game may include a visual bonus collector 270 (FIG. 5) that will be described in more detail below. However, the visual bonus collector 270 is optional.

Figure 5:
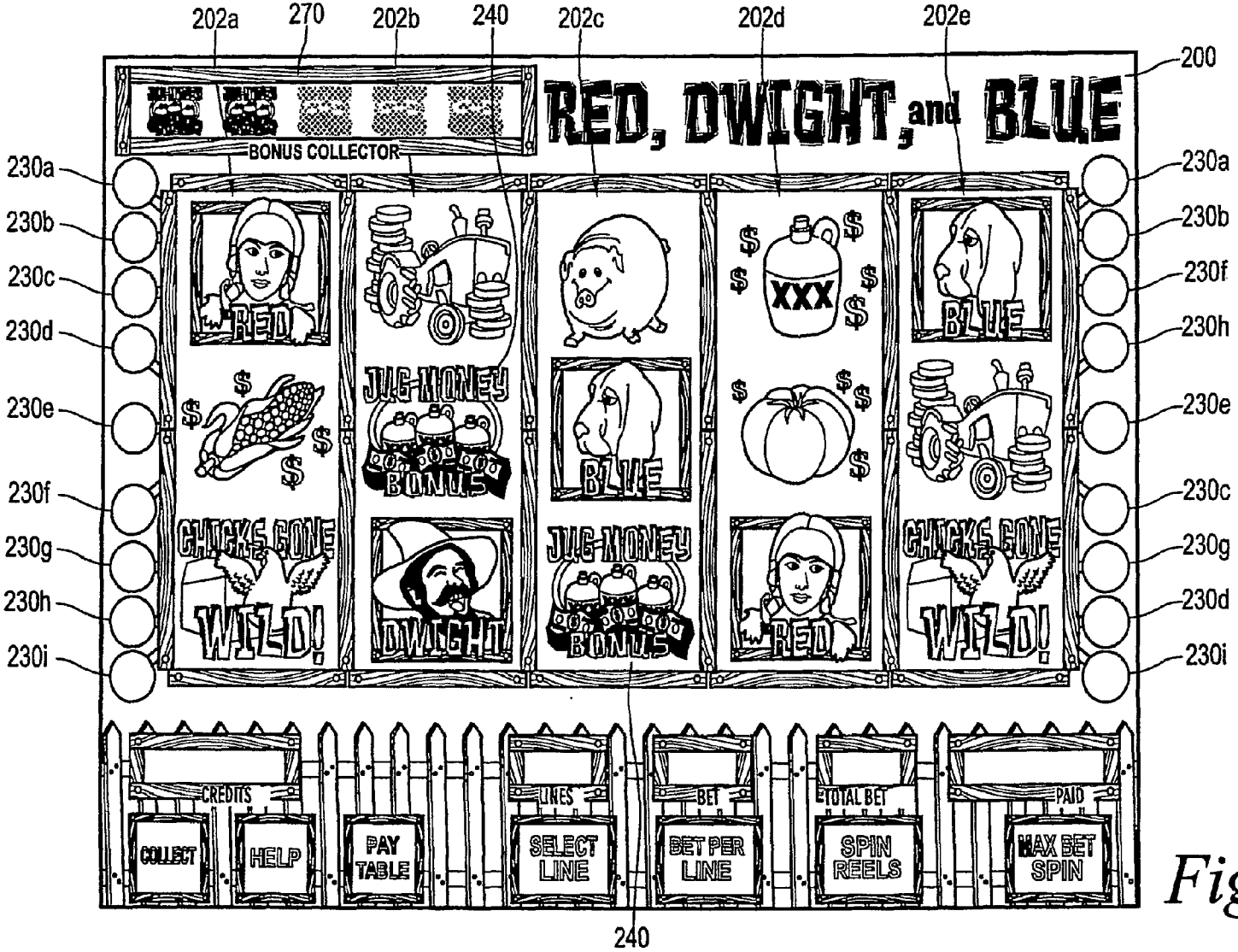
FIG. 5 is an illustration of the basic game of FIG. 3 after the reels have been spun.

FIG. 5 illustrates the reels 202*a*-202*e* of the basic game after they have been spun. In this particular embodiment, the bonus-triggering symbols are the JUG MONEY BONUS symbols 240. A bonus game is triggered when three JUG MONEY BONUS symbols 240 appear in the first three reels (202*a*-202*c*). As illustrated, only two JUG MONEY BONUS symbols 240 have landed in two of the first three reels 202*a*-202*c* after the reels 202*a*-202*e* have stopped spinning. Accordingly, a bonus game is not triggered in this embodiment because three JUG MONEY BONUS symbols 240 did not appear in the first three reels (202*a*-202*c*). However, because the JUG MONEY BONUS symbols 240 are bonus-triggering symbols, they are "collected" and stored for subsequent use by the collect-a-bonus feature. The bonus collector 270 illustrates that two JUG MONEY BONUS symbols 240 have appeared and are available for use in a subsequent basic game to achieve a bonus game.

Later, during a subsequent basic game, a bonus game is triggered if one or more JUG MONEY BONUS symbols 240 appear in the first three reels. In other words, the bonus game starts when at least three total JUG MONEY BONUS symbols 240 have been collected in a single game or over a plurality of games. The bonus collector 270 may be reset or cleared at appropriate times, for example, after each time the bonus is triggered, after a predetermined time, or after a predetermined number of plays of the basic game.

Figure 6:
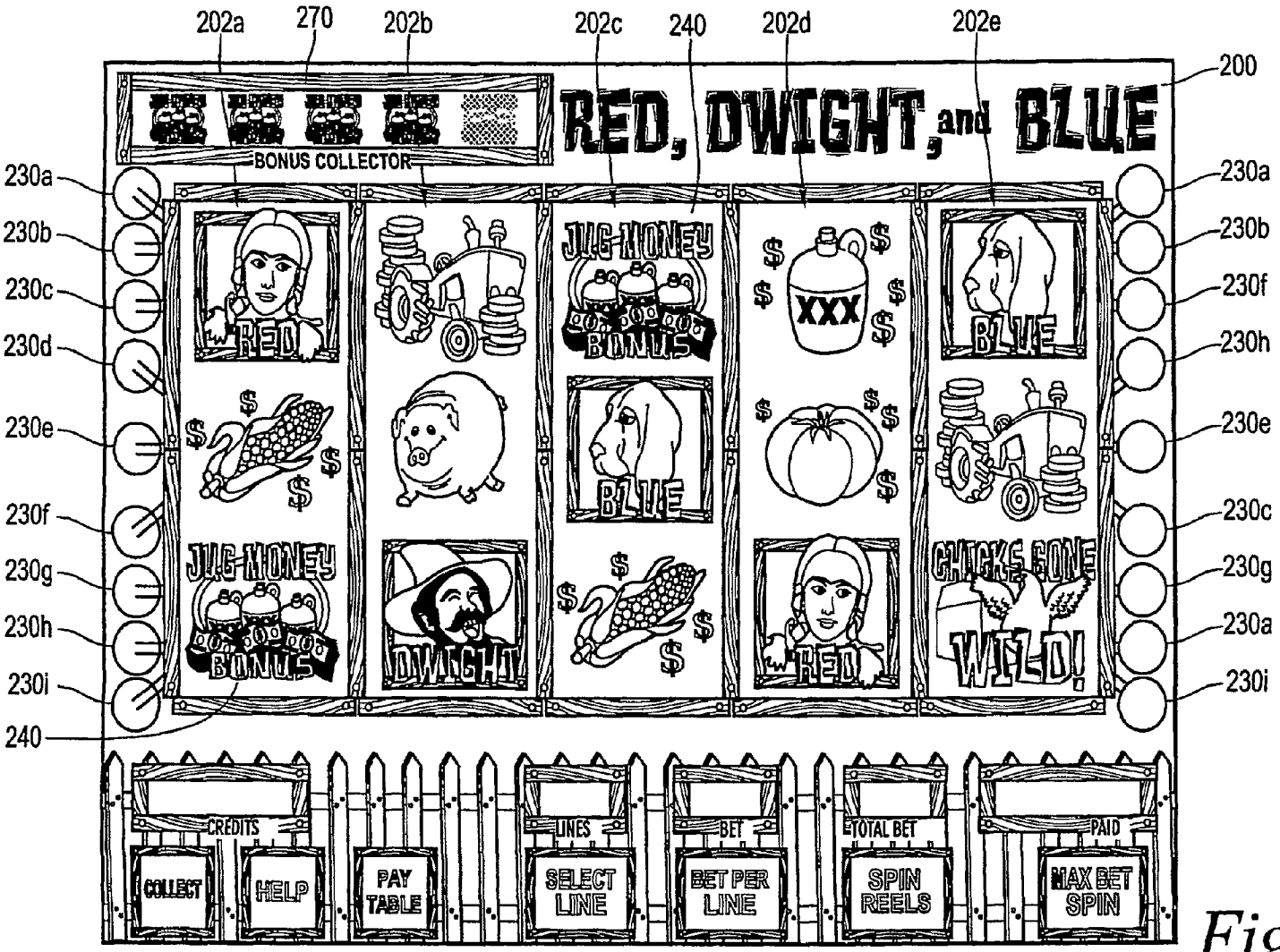
FIG. 6 is an illustration of the basic game after a subsequent spin of the reels.

In some embodiments, the player is given an enhanced bonus if the spin that collects the bonus-triggering symbol(s) pushes the total number of bonus-triggering symbols collected beyond the required number of symbols to trigger the bonus game. FIG. 6 illustrates the reels 202*a*-202*e* after a subsequent spin. In this case, another two JUG MONEY BONUS symbols 240 have appeared. Accordingly, a total of four JUG MONEY BONUS symbols 240 have now been collected by the collect-a-bonus feature and displayed in the bonus collector 270. Since at least three JUG MONEY BONUS symbols 240 have been collected, the bonus game is triggered. However, the bonus game may be enhanced because an additional JUG MONEY BONUS symbol 240 was collected. One example of a possible enhancement is to increase the credit values 262 available in the bonus game. However, other enhancements (e.g., removal of the "Sheriff Revenuer" symbols 264) are also contemplated in the illustrated bonus game (FIG. 4) and other bonus games (not illustrated).

Another aspect of the present invention includes the pay out of a credit award if a player decides to cash out and leave the game and the collect-a-bonus feature includes some, but less than the required number of bonus-triggering symbols. For example, if two JUG MONEY BONUS symbols 240 have been collected, as in FIG. 5, and the player decided to leave the game, then the gaming machine 10 will pay out a credit award and the bonus collector 270 will empty. The credit award may or may not correspond to the number of bonus-triggering symbols collected.

It should be noted that the collect-a-bonus feature may also act as a collector for enhancements to the basic game other than, or in addition to, the triggering of a bonus game. For example, a collection of a predetermined number of another type of symbols (e.g., "Chicks Gone Wild" symbol 236) could pay a progressive. Another example would include collecting a certain number of another type of symbol (e.g., "Tractor" symbol 238) to enable a multiplier enhancement wherein the payline wins would be multiplied when the certain amount is collected. This collection feature may also be utilized with different types of symbol combinations (e.g., two "Tomato" symbols 250 with one "Prize Pig" symbol 244). These symbols could be collected in a payline, scatter, or other type of format.

The basic game incorporating the present invention may be played utilizing an "auto-play" feature. The auto-play feature allows the gaming machine 10 to play through a series of games without the need for the player to push the spin button 226 (FIG. 3) each time. The machine 10 "auto-plays" until an auto-play end terminator occurs. An auto-play end terminator occurs when certain criteria is met, such as the triggering of a bonus game or the player's credit meter running to zero.

An auto-play end terminator may also include various player-selectable criteria. For example, a player may set his/her own loss-limit trigger. Essentially, the player may set the auto-play feature to continue until a player-defined amount of money is lost. Another player-selectable auto-play end terminator includes a credit-limit trigger, where the auto-play continues until a certain amount of credits is lost, as defined by the player. Another example of player-selectable criteria includes a win over a threshold credit amount. This is a situation in which the player can set the auto-play feature to end when a specific credit amount is won. The auto-play end terminator may also include any other number of player configured auto-play end terminators.

In yet additional embodiments utilizing the auto-play concept, auto-play may include certain dynamic controls. In this type of embodiment, the player may dynamically change certain playing parameters during auto-play without stopping the auto-play. Some non-limiting examples of parameters that may be dynamically controlled include the number of paylines the player would like to play and the number of bets per line the player would like to wager. As such, the wagering game sessions continue in the auto-play mode until the parameter dynamically changes, and subsequent sessions are played in accordance with the new parameters.

Each of these embodiments and obvious variations thereof is contemplated as falling within the spirit and scope of the claimed invention, which is set forth in the following claims.

What is claimed is:

1. A gaming machine for conducting a wagering game, comprising:

a wager input device for receiving a primary wager to play the wagering game; and at least one display configured to display a randomly selected outcome of a basic game of the wagering game, the randomly selected outcome being determined by a controller and being indicated on the at least one display by a plurality of symbols, at least one of the symbols is a bonus symbol that triggers a bonus game in response to a certain condition being met;

wherein in response to the randomly selected outcome including at least one bonus symbol without the certain condition being met, the at least one bonus symbol is stored in a non-transitory storage medium and does not form a part of subsequent wagering games until such time as the at least one bonus symbol is utilizable to complete the certain condition in a subsequent basic game to thereby trigger a bonus game, wherein the certain condition includes displaying a predetermined number of the bonus symbols, the predetermined number comprising a plurality of the bonus symbols, wherein the number of bonus symbols from the randomly selected outcome is less than the predetermined number of bonus symbols required to initiate the bonus game, and wherein in response to a cashout input, the player achieves an award in response to the display of a number of bonus symbols less than the required predetermined number of bonus symbols.

2. The gaming machine of claim 1, wherein the certain condition comprises a predetermined minimum number bonus symbols comprising one or more stored bonus symbols and further comprising one or more bonus symbols disclosed in the symbol combination in the array, wherein the certain condition is independent of a symbol position of the one or more bonus symbols disclosed in the symbol combination.

3. A gaming machine for conducting a wagering game, comprising:

a wager input device for receiving a primary wager to play the wagering game; and at least one display configured to display a randomly selected outcome of a basic game of the wagering game, the randomly selected outcome being determined by a controller and being indicated on the at least one display by a plurality of symbols, at least one of the symbols is a bonus symbol that triggers a bonus game in response to a certain condition being met;

wherein in response to the randomly selected outcome including at least one bonus symbol without the certain condition being met, the at least one bonus symbol is stored in a non-transitory storage medium and does not form a part of subsequent wagering games until such time as the at least one bonus symbol is utilizable to complete the certain condition in a subsequent basic game to thereby trigger a bonus game, wherein the certain condition includes displaying a predetermined number of the bonus symbols, the predetermined number comprising a plurality of the bonus symbols, and wherein the number of bonus symbols from the randomly selected outcome is more than the predetermined number of bonus symbols required to initiate the bonus game and the player achieves an enhanced bonus as a result thereof.

4. A method of conducting a wagering game on a gaming machine, the method comprising:

receiving a wager;

initiating a wagering game;

displaying a randomly selected outcome of the wagering game via a plurality of symbols selected from a set of symbols including at least one trigger symbol;

in response to the outcome of the wagering game including at least one but less than a predetermined quantity of the trigger symbols necessary to constitute a trigger condition sufficient to trigger a game feature, storing the at least one trigger symbol for use with a trigger symbol achieved in a subsequent wagering game to trigger a game feature in the subsequent wagering game in which a first portion of the trigger condition is satisfied by one or more trigger symbols displayed on one or more reels in the subsequent wagering game and a second portion of the trigger condition is satisfied by the stored at least one trigger symbol; and receiving a secondary wager to enable the act of storing the at least one trigger symbol for use with an outcome of a subsequent wagering game to trigger the game feature.

5. The method of claim 4, wherein the game feature is initiated in response to a predetermined minimum number of trigger symbols comprising one or more stored trigger symbols and further comprising one or more trigger symbols disclosed in the one or more reels in the subsequent wagering game, wherein the predetermined minimum number of trigger symbols is satisfied independent of a symbol position of the one or more trigger symbols disclosed in the one or more reels in the subsequent wagering game.

6. The method of claim 4, further comprising, displaying the collected trigger symbols, or a representation thereof, on the display device of the wagering game machine, independent from the symbols comprising the randomly determined outcomes in the plurality of plays of the wagering game.

7. A method of conducting a wagering game on a wagering game machine, the method comprising:

initiating a wagering game on the wagering game machine, the wagering game comprising the display on a display device of a randomly determined outcome comprising a plurality of symbols randomly generated by a controller from a set of game symbols, at least one of the symbols being a trigger symbol;

displaying the outcome of a plurality of plays of the wagering game with the plurality of symbols;

collecting and storing in a non-transitory storage medium trigger symbols that are achieved in the plurality of plays of the wagering game; and triggering the game feature in a subsequent play of the wagering game that includes at least one additional trigger symbol, the collected trigger symbols and the at least one additional trigger symbol being greater than a predetermined number of trigger symbols necessary for triggering the game feature, wherein the game feature is enhanced due to the number of trigger symbols present exceeding the predetermined number of trigger symbols required to initiate the game feature.

8. A gaming machine for conducting a wagering game, comprising:

a wager input device;

at least one display for displaying a randomly selected outcome of the wagering game, the randomly selected outcome being indicated by a plurality of symbols arranged in an array, the plurality of symbols selected from a set of symbols, at least one of the symbols in the set being a game feature trigger symbol;

wherein a predetermined number of game feature trigger symbols triggers a game feature, wherein, in response to one or more game feature trigger symbols in an array forming said predetermined number of game feature trigger symbols in combination with one or more previously accumulated game feature trigger symbols, the display displaying a game feature, wherein the predetermined number of game feature trigger symbols from the randomly selected outcome is more than the predetermined number of game feature trigger symbols required to initiate the game feature and the player achieves an enhanced award in the game feature as a result thereof.

9. The gaming machine of claim 8, wherein the display is further adapted to display a game feature trigger collector for displaying a collection of the game feature trigger symbols that have been collected.

10. The gaming machine of claim 8, wherein the game feature trigger symbols displayed in the array form said predetermined number of game feature trigger symbols, in combination with one or more previously accumulated game feature trigger symbols, independent of a symbol position of the game feature trigger symbols displayed in the array.

11. The gaming machine of claim 8, wherein the game feature trigger symbols are natural symbols.

* * * * *